United States Patent [19]

Kimura et al.

[11] Patent Number: 4,955,788

[45] Date of Patent: Sep. 11, 1990

[54] DRIVING LINKAGE DEVICE

[75] Inventors: Masanori Kimura; Shigetoshi Narisue; Hiroshi Nakatomi; Eito Matsuo, all of Nagasaki, Japan

[73] Assignee: Mitsubishi Jukogyo Kabushiki Kaisha, Tokyo, Japan

[21] Appl. No.: 194,284

[22] Filed: May 16, 1988

[51] Int. Cl.[5] ..... F01D 17/14

[52] U.S. Cl. ..... 415/150; 415/162; 415/166; 74/105

[58] Field of Search ..... 415/150, 159, 160, 161, 415/162, 164, 166, 163, 165; 74/99 R, 102, 105

[56] References Cited

U.S. PATENT DOCUMENTS

| | | | |
|---|---|---|---|
| 465,813 | 12/1891 | Bookwalter | 415/164 |
| 939,821 | 11/1909 | Felthousen | 415/164 |
| 1,202,310 | 10/1916 | Pfau | 415/164 |
| 4,003,675 | 1/1977 | Stevens et al. | 415/150 |
| 4,403,912 | 9/1983 | Pekari et al. | 415/150 |

FOREIGN PATENT DOCUMENTS

| | | | |
|---|---|---|---|
| 337315 | 11/1919 | Fed. Rep. of Germany | 415/150 |
| 55-49513 | 4/1980 | Japan | 415/164 |
| 58-107814 | 6/1983 | Japan . | |
| 58-176417 | 10/1983 | Japan . | |
| 61-28720 | 2/1986 | Japan . | |

*Primary Examiner*—John T. Kwon

*Attorney, Agent, or Firm*—Wenderoth, Lind & Ponack

[57] ABSTRACT

An improved driving linkage device for adjusting a variable nozzle mechanism in a supercharger turbine or a variable diffuser mechanism in a compressor. The driving linkage device is provided with a driving ring for driving a variable nozzle mechanism in a supercharger turbine or a variable diffuser mechanism in a compressor, one or more sets of adjusting links, each set consisting of three levers connected in a U-shape and having two opposed ones coupled to the driving ring and a fulcrum for supporting the lever not coupled to the driving ring. One end of one adjusting link is coupled to an actuator to achieve the adjustment of a variable nozzle mechanism in a supercharger or of a variable diffuser mechanism in a compressor.

10 Claims, 1 Drawing Sheet

DRIVING LINKAGE DEVICE

BACKGROUND OF THE INVENTION

1. Field of the Invention

The present invention relates to a driving linkage device applicable to a variable nozzle mechanism in a supercharger turbine or a variable diffuser mechanism in a compressor.

2. Description of the Prior Art

As a variable nozzle mechanism of a supercharger turbine, for instance, those having the structure shown in FIG. 2 have been heretofore known. In this figure, reference numeral 1 designates a driving ring rotated by an actuator 2. Along the inner circumferential surface of this driving ring 1 are disposed a bearing 3 divided into a plurality of bearing pieces, and at the center of the above-mentioned driving ring 1 is disposed a radial turbine 4. To the above-described driving ring 1 are mounted a plurality of nozzle vanes 5. Each of these nozzle vanes 5 is composed of a vane main body 6 and a lever 7. At one end of this lever 7 is formed a U-shaped slot, and this slot is engaged with a pin 8 studded on the above-mentioned driving ring 1. Also, the other end of the above-described lever 7 is connected to the afore-mentioned vane main body 6 via a fulcrum 9, and the above-mentioned vane main body 6 can freely rotate about that fulcrum 9.

In the variable nozzle mechanism having the above-described construction, if the driving ring 1 is rotated by the actuator 2, the plurality of pins 8 studded on that ring 1 are also moved, hence according to this movement, the levers 7 of the respective nozzle vanes 5 engaged with the respective pins 8 via the slots are driven, and the vane main bodies 6 rotate about the respective fulcrums 9. Accordingly, in response to the movement of the vane main bodies 6 of the respective nozzle vanes 5 coupled to the driving ring 1, a stroke-width W between the nozzle vanes 5 changes, and thereby an adjusting operation for the variable nozzle is carried out.

However, in the above-described construction, since the drive in the circumferential direction of the driving ring 1 is effected by applying a force to one location on the driving ring 1 to which the actuator 2 is coupled, a large force is exerted upon the driving ring 1 in one direction. As a result, the contact between the driving ring 1 and the bearing 3 takes the state like point contact, and so, where was a problem in that anomalous abrasion would arise between the driving ring 1 and the bearing 3.

SUMMARY OF THE INVENTION:

It is therefore one object of the present invention to provide an improved driving linkage device that is free from the above-mentioned disadvantage in the prior art.

A more specific object of the present invention is to provide a driving linkage device for use in a variable nozzle or a variable diffuser, in which a bearing for supporting a driving ring can be omitted to obviate the problem of anomalous abrasion between the driving ring and the bearing therefor.

According to one feature of the present invention, there is provided a driving linkage device provided with a driving ring for driving a variable nozzle or a variable diffuser, and one or more sets of adjusting links, each set consisting of three levers connected in a U-shape and having two opposed ones coupled to the driving ring and a fulcrum for supporting the lever not coupled to the driving ring.

According to the present invention, in a driving linkage device, since mechanical power generated by an actuator or the like is transmitted to the driving ring by means of one or more sets of adjusting links, each set consisting of three levers connected in a U-shape and having two opposed ones coupled to the driving ring and a fulcrum for supporting the lever not coupled to the driving ring, even if the bearing should be omitted, drive of the driving ring in the circumferential direction can be achieved while maintaining the center point of the above-mentioned ring, and as a result, the anomalous abrasion between the driving ring and the bearing can be eliminated.

Therefore, the present invention can provide advantages in that by eliminating the contact between the driving ring and the bearing therefore, improvements in mechanical efficiency as well as reduction of abrasion can be attained, and consequently, a highly reliable driving linkage device that is favorable for a variable nozzle mechanism in a turbine or a variable diffuser mechanism in a compressor, can be provided.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
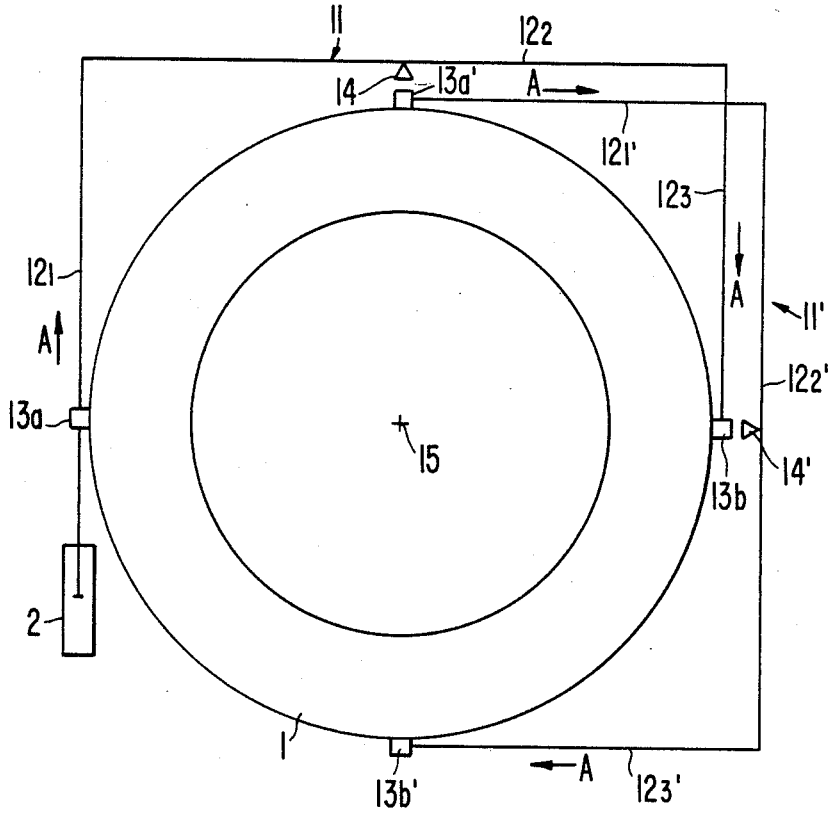
FIG. 1 is a schematic view showing a driving linkage device according to one preferred embodiment of the present invention.
Figure 2:
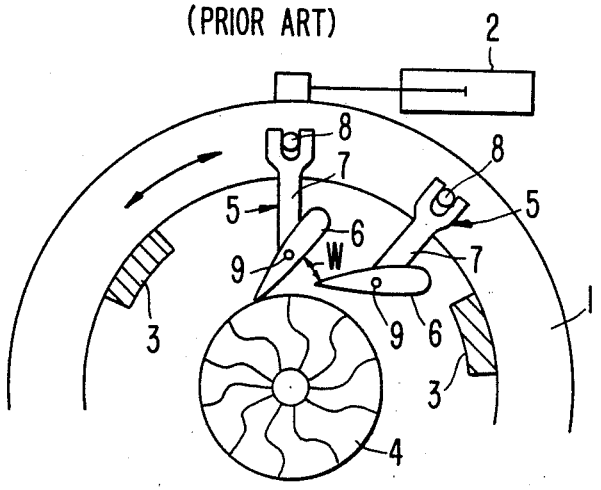
FIG. 2. (PRIOR ART)
FIG. 2 is a schematic view showing a variable nozzle mechanism in a supercharger turbine in the prior art.

In the following, one preferred embodiment of the present invention will be described with reference to FIG. 1.

In this figure, numerals 11 and 11' are two sets of adjusting links. One set of adjusting links 11 includes three levers $12_1$–$12_3$ connected in a U shape. Among these levers $12_1$–$12_3$, end portions of the opposed levers $12_1$ and $12_3$ are coupled to a driving ring 1 via projections **13*a* and 13*b*, respectively, and at the center of the remaining lever $12_2$ is provided a fulcrum 14. The other set of adjusting links 11' includes three levers $12_1'$–$12_3'$ connected in a U-shape. Among these levers $12_1'$–$12_3'$, end portions of the opposed levers $12_1'$ and $12_3'$ are coupled to the same driving ring 1 via projections 13*a'* and 13*b'*, respectively, provided on the circumferential surface of the driving ring 1 as displaced by 90° from the above-mentioned projections 13*a* and 13*b*, and at the center of the remaining lever $12_2'$ is provided a fulcrum 14' radially aligned with connection 136 in the same manner that the fulcrum 14 is radially aligned with the connection 13*a*. In addition, an actuator 2 is coupled to the projection 13*a* provided on the above-described driving ring 1**.

According to the above-mentioned construction, when a force A is applied to the projection **13*a* on the driving ring 1, the force A is exerted upon the lever $12_1$ in one set of adjusting links 11. At the same time, according to the principle of a "ever" that is rockable about the fulcrum 14 supporting the lever $12_2$, a force A directed in the opposite direction to that exerted upon the lever $12_1$ is exerted upon the lever $12_3$. In this way, owing to the fact that a single force generated by the actuator 2 was applied to the driving ring 1 as two vertical forces A directed in the upper direction and in the lower direction with the aid of the levers $12_1$ and $12_3$ in the set of adjusting links 11, the forces directed in the upper and lower directions and applied to the driving ring 1** would be balanced.

In addition, as a result of the application of the forces A to the driving ring 1, the force A also acts upon the lever $12_1'$ in the other set of adjusting links 11' coupled to the driving ring 1 via the projection 13a'. When the force A acts upon the lever $12_1'$, according to the principle of a "lever" that is rockable about the fulcrum 14' supporting the lever $12_2'$, a force A directed in the opposite direction to that exerted upon the lever $12_1'$is exerted upon the lever $12_3'$. In this way, owing to the fact that a single force generated by the actuator 2 was applied to the driving ring 1 as two horizontal forces A directed in the left direction and in the right direction with the aid of the levers $12_1'$ and $12_3'$ in the other set of adjusting links 11', the forces directed in the left and right directions and applied to the driving ring 1 would be balanced.

As described above, despite the fact that a single force is applied from a single actuator 2 to one location on the driving ring 1, equal forces would act upon four locations on the driving ring 1, the resultant force of these forces would become zero, and therefore, the position of the center point 15 of the driving ring 1 can be preserved. Accordingly, even if the bearing disposed along the inner circumferential surface of the driving ring should be omitted such that the inner circumferential surface of the ring comprises a bearing free surface, drive of the driving ring 1 in the circumferential direction can be achieved while maintaining the same position of the center point 15, and hence the frictional abrasion between the driving ring and the bearing as occurred in the prior art can be obviated.

It is to be noted that while the driving linkage device was constructed by making use of two sets of adjusting links in the above-described embodiment, the driving linkage device could be formed by making use of one set or three or more sets of adjusting links.

As described in detail above, according to the present invention, improvements in mechanical efficiency as well as reduction of frictional abrasion can be attained by eliminating the contact between the driving ring and the bearing therefor, and consequently, a highly reliable driving linkage device that is favorable for a variable nozzle mechanism in a turbine or a variable diffuser mechanism in a compressor, can be provided.

While a principle of the present invention has been described above in connection with one preferred embodiment of the invention, it is intended that all matter contained in the above description and illustrated in the accompanying drawings shall be interpreted to be illustrative and not as a limitation to the scope of the invention.

What is claimed is:

1. A driving linkage device comprising:

a driving ring of a device such as a variable nozzle or a variable diffuser;

means rotatably supporting said ring in a bearing-free state with a center point of said ring maintained in one position when said ring is rotated about said center point, said means for supporting said ring including two sets of adjusting links, each said set including two spaced substantially parallel levers and a third lever directly pivotally connected to said two levers at respective locations space along said third lever, said two levers extending in the same direction towards, and directly pivotally connected to, said ring at circumferentially spaced-apart positions on said ring, and said third lever being pivotally supported by a fulcrum; and an actuator attached to an outer periphery of said ring for rotation thereof.

2. The device of claim 1, wherein said spaced-apart positions are diametrically opposed.

3. The device of claim 1, wherein said two levers are supported in a bearing-free state only by said ring and said third lever.

4. The device of claim 1, wherein said ring includes an inner circumferential surface, said inner circumferential surface comprising a bearing-free surface.

5. The device of claim 1, wherein each of said two levers are connected to said ring at one end thereof and are connected to said third lever at the other end thereof.

6. The device of claim 5, wherein said fulcrum pivotally supports said third lower at a position located at the center thereof.

7. The device of claim 1, wherein said levers connected to said ring are connected to said ring at positions spaced 90 degrees apart.

8. The device of claim 1, wherein said driving ring further comprises a plurality of circumferentially spaced pins extending outwardly from the plane of said driving ring, and said device further comprising, a plurality of nozzle vanes disposed radially within the circumference of said driving ring, and a plurality levers, each of said levers having a first end fixed to an associated one of said nozzle vanes and a second forked end slidingly receiving an associated one of said pins on said driving ring.

9. A driving linkage device comprising:

a driving ring for driving a variable nozzle or a variable diffuse;

two sets of adjusting links, each said set consisting of three levers connected in a U-shape, two of said levers being opposed to each other and coupled to said driving ring;

a fulcrum supporting each third one of said levers which is coupled to each of said opposed levers and is not coupled to said driving ring; and an actuator coupled to one end of one of said levers of one of said sets of adjusting links.

10. The device of claim 9, wherein said driving ring further comprises a plurality of circumferentially spaced pins extending outwardly from the plane of said driving ring, and said device further comprising, a plurality of nozzle vanes disposed radially within the circumference of said driving ring, and a plurality levers, each of said levers having a fist end fixed to an associated one of said nozzle vanes and a second forked end slidingly receiving an associated one of said pins on said driving ring.

* * * * *